US006179070B1

(12) United States Patent
Dietzen

(10) Patent No.: US 6,179,070 B1
(45) Date of Patent: Jan. 30, 2001

(54) VACUUM TANK FOR USE IN HANDLING OIL AND GAS WELL CUTTINGS

(75) Inventor: Gary Dietzen, Lafayette, LA (US)

(73) Assignee: M-I L.L.C., Houston, TX (US)

( * ) Notice: Under 35 U.S.C. 154(b), the term of this patent shall be extended for 0 days.

(21) Appl. No.: 09/182,623

(22) Filed: Oct. 29, 1998

Related U.S. Application Data

(63) Continuation-in-part of application No. 09/071,820, filed on May 1, 1998, now Pat. No. 5,971,084, which is a continuation-in-part of application No. 09/039,178, filed on Mar. 13, 1998, now Pat. No. 5,913,372, which is a continuation-in-part of application No. 08/950,296, filed on Oct. 14, 1997, now Pat. No. 6,009,959, which is a continuation-in-part of application No. 08/813,462, filed on Mar. 10, 1997, now Pat. No. 5,839,521, which is a continuation-in-part of application No. 08/729,872, filed on Oct. 15, 1996, now Pat. No. 5,842,529, which is a continuation-in-part of application No. 08/416,181, filed on Apr. 4, 1995, now Pat. No. 5,564,509, which is a continuation-in-part of application No. 08/197,727, filed on Feb. 17, 1994, now Pat. No. 5,402,857.

(51) Int. Cl.[7] ..... E21B 7/00; E21B 21/06
(52) U.S. Cl. ..... 175/66; 175/207; 414/409
(58) Field of Search ..... 175/66, 206, 207; 405/128; 134/108; 414/409, 410, 422

(56) References Cited

U.S. PATENT DOCUMENTS

| | | | |
|---|---|---|---|
| D. 296,027 | 5/1988 | Dietzen | D34/39 |
| D. 337,809 | 7/1993 | Dietzen | D23/202 |
| 1,125,413 | 1/1915 | Van Doren . | |
| 2,803,501 | 8/1957 | Kelly | 302/17 |
| 3,400,819 | 9/1968 | Burdyn | 175/66 |
| 3,433,312 | 3/1969 | Burdyn et al. | 175/66 |
| 3,993,359 | 11/1976 | Sweeney | 302/15 |

(List continued on next page.)

FOREIGN PATENT DOCUMENTS

| | | |
|---|---|---|
| 0 005 273 | 5/1979 | (EP) . |
| 2162880 | 2/1986 | (GB) . |

*Primary Examiner*—Frank Tsay
(74) *Attorney, Agent, or Firm*—Howrey Simon Arnold & White, LLP

(57) ABSTRACT

A vacuum tank apparatus for use with oil and gas well drilling operations facilitates the removal of well cuttings generated by drilling. The tank apparatus provides a frame having a plurality of corners reinforced by structural corner columns. The frame includes a base having a structural, generally horizontally extended base that includes a plurality of base perimeter beams. The columns are connected structurally to the base at the perimeter beams. The upper end portion of the frame includes a plurality of upper perimeter beams. The columns are structurally connected to the base and the perimeter beams. A shaped hopper is supported by the frame internally of the perimeter beams. The hopper includes an interior and a sidewall comprised of a plurality of inclined wall sections. Each wall section includes an upper end portion that connects to the frame at the perimeter beams, and a lower end portion that extends to another lower end portion of another inclined wall section. An outlet header at the bottom of the hopper next to the lower end portions of the inclined wall sections is provided. The outlet header includes a discharge outlet for discharging solid material from the hopper interior. The outlet header includes an inlet fitting for injecting pressurized into the outlet header during an emptying of the tank. A top wall of the hopper has multiple hatches that include a first hatch near a perimeter beam and a second hatch next to a second perimeter beam that is parallel to the first perimeter beam. These hatches enable material to be added to the tank interior during use, such as, for example, by employing a pair of suction lines that are connected to a single plate covering one of the outlets in the tank top or a pair of suction lines that are mounted respectively to the pair of inlet openings.

31 Claims, 5 Drawing Sheets

U.S. PATENT DOCUMENTS

| | | | |
|---|---|---|---|
| 4,019,641 | 4/1977 | Merz | 214/14 |
| 4,030,558 | 6/1977 | Morris | 175/206 X |
| 4,565,086 | 1/1986 | Orr, Jr. | 73/23 |
| 4,595,422 | 6/1986 | Hill et al. | 175/206 X |
| 4,793,423 | 12/1988 | Knol | 175/66 |
| 4,878,576 | 11/1989 | Dietzen | 198/494 |
| 4,942,929 | 7/1990 | Malachosky et al. | 175/66 |
| 5,016,717 | 5/1991 | Simons et al. | 175/66 |
| 5,109,933 | 5/1992 | Jackson | 175/66 |
| 5,190,085 | 3/1993 | Dietzen | 141/98 |
| 5,322,393 | 6/1994 | Lundquist | 406/38 |
| 5,341,856 | 8/1994 | Appenzeller | 141/67 |
| 5,344,570 | 9/1994 | McLachlan et al. | 175/66 |
| 5,564,509 | 10/1996 | Dietzen | 175/66 |
| 5,839,521 | 11/1998 | Dietzen | 175/66 |
| 5,842,529 | 12/1998 | Dietzen | 175/66 |

VACUUM TANK FOR USE IN HANDLING OIL AND GAS WELL CUTTINGS

CROSS-REFERENCE TO RELATED APPLICATIONS

This is a continuation-in-part of U.S. Pat. application Ser. No. 09/071,820, filed May 1, 1998, now U.S. Pat. No. 5,971,084, which is a continuation-in-part of U.S. patent application Ser. No. 09/039,178, filed Mar. 13, 1998, now U.S. Pat. No. 5,913,372, which is a continuation-in-part of U.S. Patent application Ser. No. 08/950,296, filed Oct. 14, 1997, now U.S. Pat. No. 6,009,959, which is a continuation-in-part of U.S. patent application Serial No. 08/813,462, filed Mar. 10, 1997 which is a continuation-in-part of U.S. patent. application Ser. No. 08/729,872, filed Oct. 15, 1996, which is a continuation-in-part of copending U.S. Pat. application Ser. No. 08/416,181, filed Apr. 4, 1995 (now U.S. Pat. No. 5,564,509) which is a continuation-in-part of U.S. patent application Ser. No. 08/197,727, filed Feb. 17, 1994 (now U.S. Pat. No. 5,402,857), each of which is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to oil and gas well drilling and more particularly to the handling of cuttings that are generated during oil and gas well drilling activity. Even more particularly, the present invention relates to an improved vacuum tank apparatus for use in handling cuttings that are generated during oil and gas well exploration. The tank has a specially configured hopper that communicates with an outlet header that enables air to be injected during the discharge of cuttings from the tank.

2. General Background of the Invention

In the drilling of oil and gas wells, a drill bit is used to dig many thousands of feet into the earth's crust. Oil rigs typically employ a derrick that extends above the well drilling platform and which can support joint after joint of drill pipe connected end to end during the drilling operation. As the drill bit is pushed farther and farther into the earth, additional pipe joints are added to the ever lengthening "string" or "drill string". The drill pipe or drill string thus comprises a plurality of joints of pipe, each of which has an internal, longitudinally extending bore for carrying fluid drilling mud from the well drilling platform through the drill string and to a drill bit supported at the lower or distal end of the drill string.

Drilling mud lubricates the drill bit and carries away well cuttings generated by the drill bit as it digs deeper. The cuttings are carried in a return flow stream of drilling mud through the well annulus and back to the well drilling platform at the earth's surface. When the drilling mud reaches the surface, it is contaminated with small pieces of shale and rock which are known in the industry as well cuttings or drill cuttings.

Well cuttings have in the past been separated from the reusable drilling mud with commercially available separators that are know as "shale shakers". Other solids separators include mud cleaners and centrifuge. Some shale shakers are designed to filter coarse material from the drilling mud while other shale shakers are designed to remove finer particles from the well drilling mud. After separating well cuttings therefrom, the drilling mud is returned to a mud pit where it can be supplemented and/or treated prior to transmission back into the well bore via the drill string and to the drill bit to repeat the process.

The disposal of the separated shale and cuttings is a complex environmental problem. Drill cuttings contain not only the mud product which would contaminate the surrounding environment, but also can contain oil that is particularly hazardous to the environment, especially when drilling in a marine environment.

In the Gulf of Mexico for example, there are hundreds of drilling platforms that drill for oil and gas by drilling into the subsea floor. These drilling platforms can be in many hundreds of feet of water. In such a marine environment, the water is typically crystal clear and filled with marine life that cannot tolerate the disposal of drill cuttings waste such as that containing a combination of shale, drilling mud, oil, and the like. Therefore, there is a need for a simple, yet workable solution to the problem of disposing of oil and gas well cuttings in an offshore marine environment and in other fragile environments where oil and gas well drilling occurs.

Traditional methods of cuttings disposal have been dumping, bucket transport, cumbersome conveyor belts, screw conveyors, and washing techniques that require large amounts of water. Adding water creates additional problems of added volume and bulk, messiness, and transport problems. Installing conveyors requires major modification to the rig area and involves many installation hours and very high cost.

Safeguard Disposal Systems, Inc. of Lafayette, Louisiana has manufactured, sold, and used publicly a cuttings disposal tank that includes hatch openings into which oil well cuttings can be placed. These prior art tanks also have attachments for enabling lift lines to be affixed to the tank so that it can be transported to and from offshore platforms and emptied when full. Further examples of these tanks are shown in one or more of the following U.S. Pat. Nos.: 5,564,509; 5,402,857; U.S Pat. Nos. Des. 337,809; and U.S Pat. Nos. Des. 296,027. U.S. Pats. Nos. 5,564,509 and 5,402,857 are incorporated herein by reference.

BRIEF SUMMARY OF THE INVENTION

The present invention provides and improved vacuum tank apparatus that can be used to vacuum drill cuttings on an oil and gas well drilling rig through an open top hatch portion of the apparatus and then to discharge those cuttings through an outlet header using suction applied to the outlet header as well as compressed injected air that is transmitted to the outlet header. The apparatus includes a frame having a plurality of corners reinforced by structural corner columns, a generally horizontally extended base the includes a plurality of base perimeter beams, and an upper end portion of the frame that includes a plurality of upper perimeter beams. The columns are structurally interconnected to both the upper perimeter beams and the base of the frame.

A shaped hopper is supported by the frame internally of the perimeter beams. The hopper includes and interior and sidewalls that are comprised of a plurality of inclined sidewall sections, each inclined wall section including an upper end portion that connects to the frame at the perimeter beams and a lower end portion that extends to another lower end portion of another inclined wall section. The two lower end portions of the inclined wall sections that are joined meet at an outlet header at the bottom of the hopper. This outlet header is mated to the lower end portions of the inclined wall sections and includes a discharge outlet for discharging material from the hopper interior via the outlet header.

The top wall of the hopper has multiple hatches including a first hatch near a first perimeter beam and a second hatch next to another perimeter beam that is parallel to the first perimeter beam.

The outlet header includes opposed open end portions that are fittings for directing fluid flow. One of the end portions is an air inlet for injecting air into the outlet header. The other end portion of the outlet header defines a fitting for connecting a suction line thereto. A secondary air fitting for enhanced cleanout and material transfer can be provided at the discharge fitting.

These two fittings enable material to be quickly discharged from the hopper even if it is very solid in nature such as granular cuttings that are the subject of oil and gas well drilling. These cuttings can be quickly discharged from the tank through the outlet header by injecting air into the outlet header at the first end portion of the outlet header and by suctioning the cuttings from the opposing end portion of the outlet header.

The outlet header thus preferably comprises a longitudinally extended trough portion with an open top that communicates with the interior of the hopper. A pair of opposed end portions of the trough have fittings for attaching flow lines to the outlet header.

The outlet header thus defines a closed structure with the lower end portion of the hopper and the fittings so that a vacuum can be held on the tank when the outlet header is not being used.

The outlet header preferably provides valves at each end portion next to the two fittings so that the flow of air into the outlet header can be valved. Additionally, the discharge of solid material from the outlet header can also be valved.

The apparatus of the present invention eliminates the dangerous and messy practices of lifting and/or tipping the tank frame on an oil rig in order to empty the tank contents.

The inclined walls of the hopper remove any need to tip or lift the tank during emptying. The hopper is configured to completely empty of material using a vacuum and without tipping or lifting thus eliminating a crane or cranes.

This also removes safety concerns involved with lifting or tipping such as spilling and pollution.

Existing tanks must be lifted and tilted which requires dual block heavy lifting cranes since they can weigh over ten tons when loaded.

This enables the apparatus of the present invention to be emptied at a location where there are no cranes.

Several of such tanks can be transported from several oil rigs to a central processing location. This is valuable because drilling rigs are typically very crowded. Use of a lifting crane in such a crowded environment for dumping.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
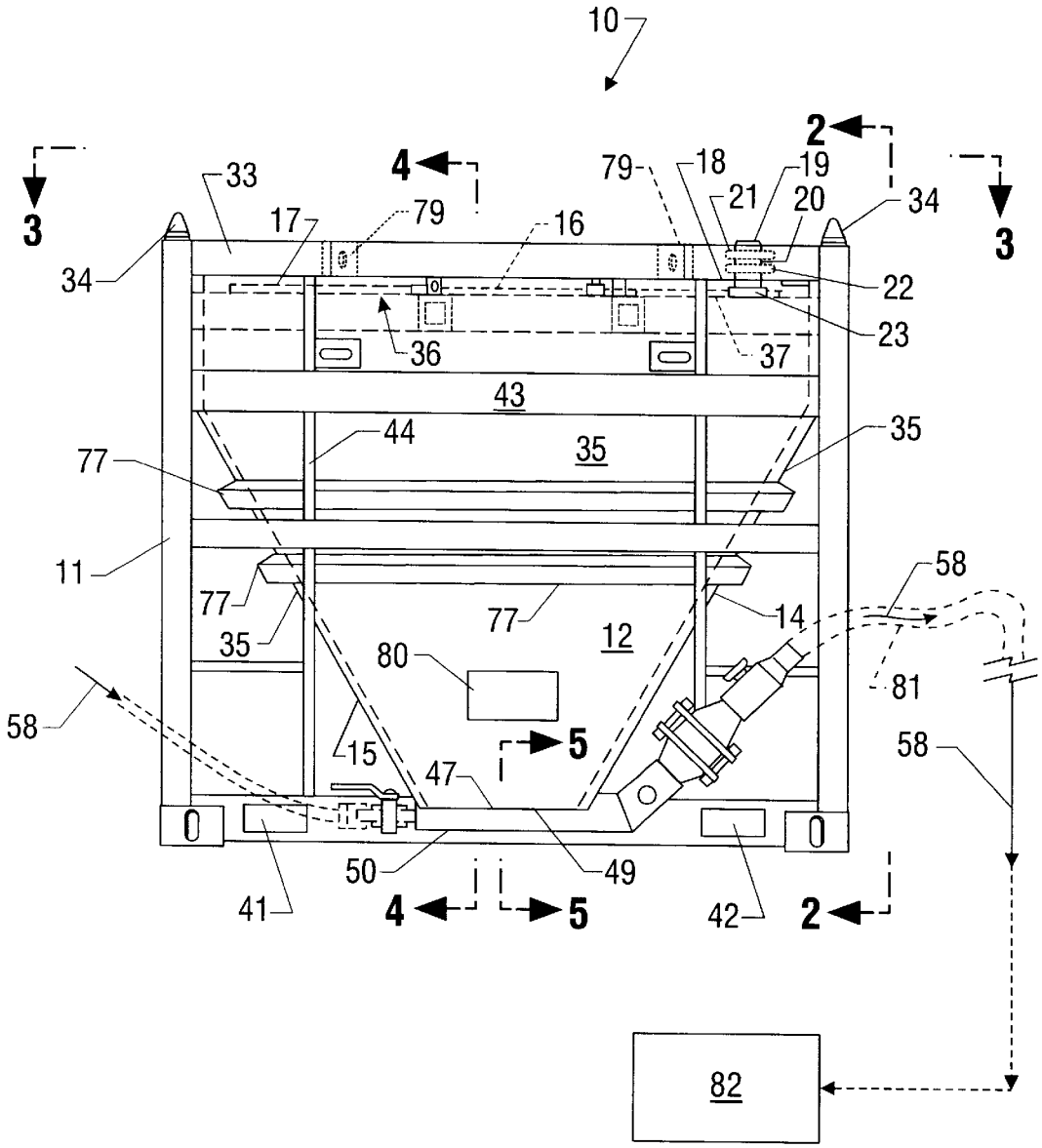
FIG. 1 is an elevational view of the preferred embodiment of the apparatus of the present invention.

FIGS. 1–4 show the preferred embodiment of the apparatus of the present invention designated generally by the numeral 10 in FIGS. 1–4. Vacuum tank apparatus 10 is supported by a structural frame 11. The frame 11 holds a hopper 35 that is comprised of a plurality of hopper walls 12, 13, 14, 15. A vibrator motor 80 can be affixed to one or more of the walls 12–15 to enhance setting of material within hopper 35 interior 38. The hopper 35 also includes a top plate 16 that carries a large hatch 17 and a small hatch 18. Each of the hatches 17, 18 respectively covers large opening 36 and small opening 37 respectively. Large hatch 17 is preferably used to dump material from the interior 38 of hopper 35 if desired.

Top plate 16 that seals the hopper 35 at its upper end portion so that a vacuum can be pulled on the interior 38 of hopper 35.

Figure 7:
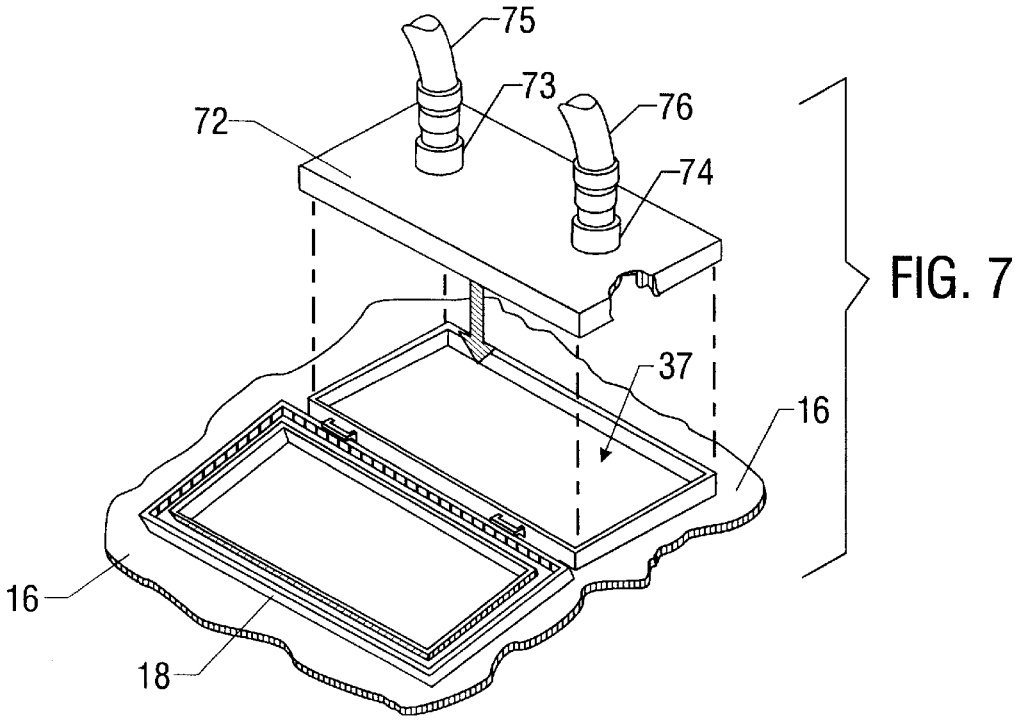
FIG. 7 is a fragmentary perspective view of the preferred embodiment of the apparatus of the present invention showing the hatch and opening in an open position so that vacuum hoses can be attached.
Figure 8:
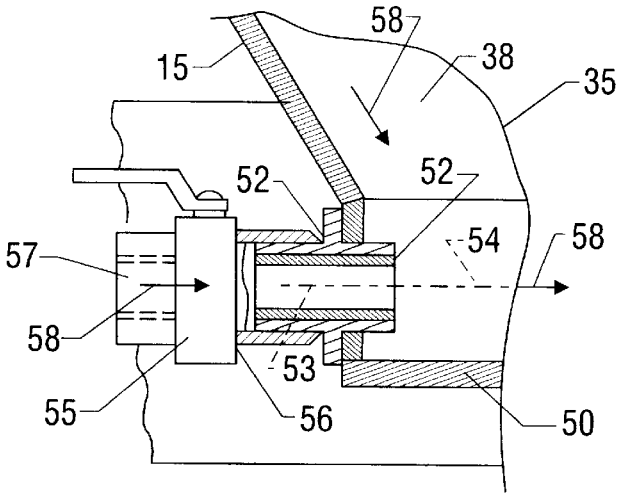
FIG. 8 is a fragmentary elevational sectional view of the preferred embodiment of the apparatus of the present invention illustrating the compressed air inlet portion thereof.
Figure 10:
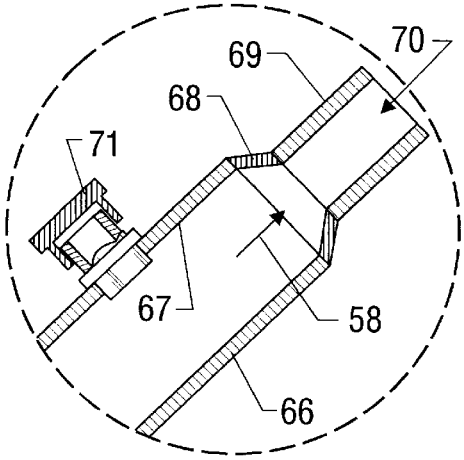
FIG. 10 is a fragmentary sectional view showing an enlarged portion of the discharge piping for removing material from the tank.

An outlet fitting 19 carries rupture disk 20. The outlet fitting 19 can include a pair of spaced apart flanges 21, 22 as shown in FIG. 7. Fitting 19 is mounted on tank outlet opening 23. An additional fitting is provided at elbow 24 that communicates with opening 26 in top plate 16. The elbow 24 carries a ball valve 25 that can be opened and closed. When hopper 35 is subjected to a vacuum, rupture disk 20 prevent tank rupture.

Each of the hatches 17, 18 is mounted to the top plate 16 using hinges 27, 28 respectively. A closure 29, 30 can be respectively provided for each hatch 17, 18 in the form of a cammed rod such as the rods 39, 40 shown in FIG. 3. Alternatively, ring nuts and bolts can be used to close hatches 17, 18.

Frame 11 is comprised of a plurality of base beams 31, column beams 32 and upper perimeter beams 33 as shown in FIGS. 1-4. These respective beams 31, 33, and column 32 form a rectangular block-like enclosure that protects hopper 35 during transportation. The base perimeter beams 31 can additionally be provided with plate for decking if desired.

Left and right sockets 41, 42 define receptacles for fork lift tines at each perimeter beam 31 so that the apparatus 10 of the present invention can be lifted and transported using a fork lift if desired.

Figure 2:
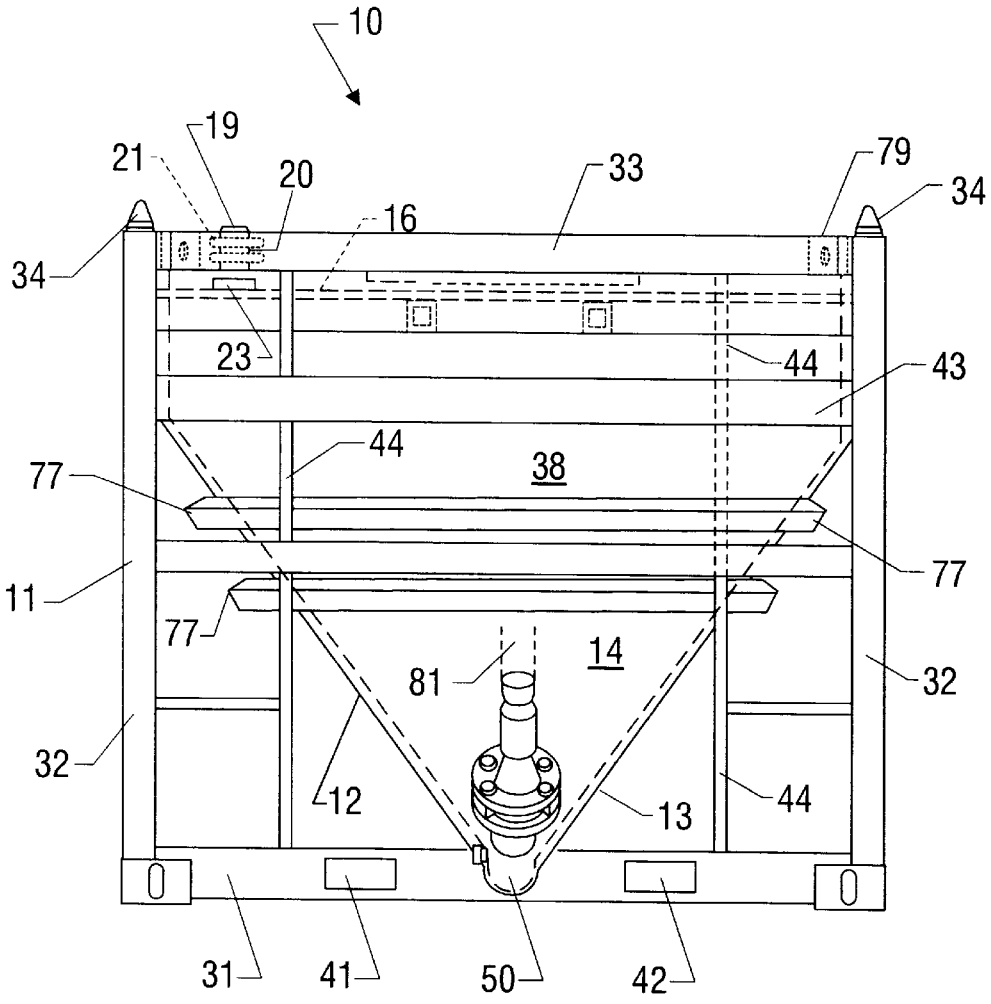
FIG. 2 is a sectional view taken along lines 2—2 of FIG. 1.
Figure 4:
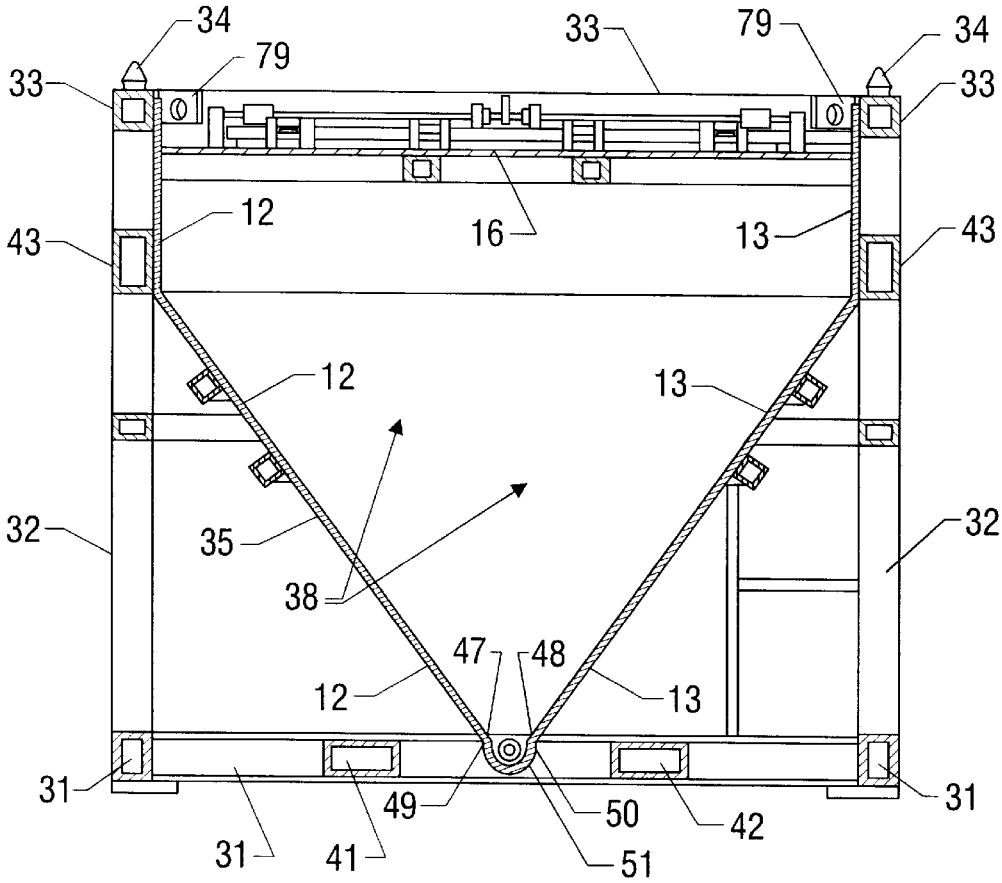
FIG. 4 is a sectional elevational view of the preferred embodiment of the apparatus of the present invention taken along lines 4—4 of FIG. 1.

Each of the column beams 32 occupies a corner of the frame 11 as shown in FIG. 1–4. Each column beam 32 provides a stacking pin 34 at its upper end portion as showing in FIGS. 1-4 and 7. A correspondingly shaped socket under each column 32 at a perimeter beam 31 receives a stacking pin 34 when one tank apparatus 10 is stacked upon another tank 10. Lifting eyes 79 and slings can be attached to tank apparatus 10 for enabling a crane to lift the apparatus 10 during transfer to and from the drilling rig. The frame 11 can also includes additional intermediate horizontal beams 43 and vertical beams 44 that define an interface in between selected ones of the base beams 31, column beams 32 and upper perimeter beams 33. The intermediate perimeter beams 43 are generally parallel to and below upper perimeter beams 33. Each intermediate beam 43 connects to and spans between two columns 32 as shown in FIGS. 1, 2 and 4.

Figure 5:
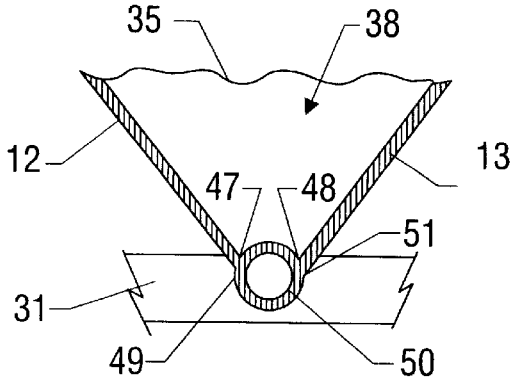
FIG. 5 is a fragmentary view of the preferred embodiment of the apparatus of the present invention illustrating the outlet header portion thereof, taken along lines 5—5 of FIG. 1.
Figure 3:
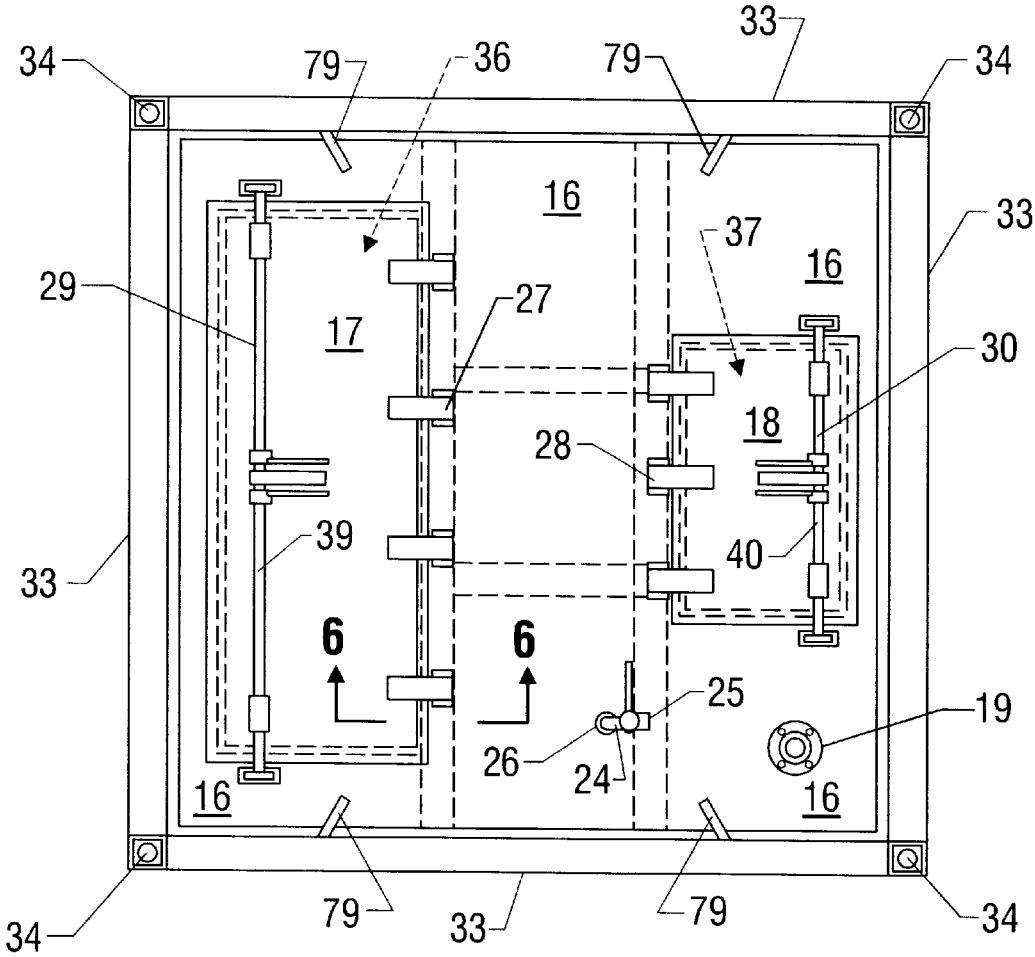
FIG. 3 is a top view of the preferred embodiment of the apparatus of the present invention taken along lines 3—3 of FIG. 1.
Figure 6:
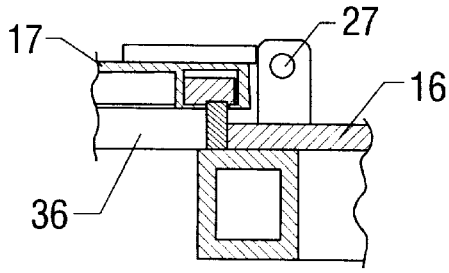
FIG. 6 is a sectional view taken along lines 6—6 of FIG. 3.

Of the plurality of hopper walls 12, 13, 14, 15, at least two of these walls 12, 13 (and preferably all four walls 12-15) converge to form a connection with outlet header 50. Stiffners 77 can be welded to the walls 12, 13, 14, 15 for strengthening them. The walls 12, 13, 14, 15 each include inclined sections in between beams 31 and 43. The hopper 35 is thus shaped to enable complete emptying and discharge of drill cuttings and like material using a source of vacuum and without having to tip or lift the tank. The present invention eliminates the need for manual labor to shovel or scrape material to header 50. Each of the walls 12, 13, 14, 15 has a vertical section between beams 43 and 32. Outlet header 50 is shaped to facilitate discharge of material contained in hopper 35, shown in FIGS. 1, 2, 4, 5, 8, 9, and 10. The outlet header includes a channel section 46 that is connected to the lower edge 47 of wall 12 of hopper 35 and to the lower edge 48 of wall 13 of hopper 35 as shown particularly in FIGS. 4 and 5.

The channel section provides a U - shaped trough in transverse cross section. The upper edges 49, 51 of channel section 49 are connected (eg. welded) to the lower edges 47, 48 of sides 12, 13 of hopper 35. At wall 15 of hopper 35, an inlet fitting 52 is provided for injecting air under pressure. The fitting 52 can be a cylindrically shaped member having a central longitudinal bore with a central longitudinal axis that aligns with the central longitudinal axis 54 of channel section 49. Valve 55 can be positioned on the inlet 56 side of fitting 52 for closing the flow via fitting 52 to channel section 49. Upstream of valve 55 is a quick connect member that enables an air hose to quickly be connected to the assembly of fitting 52, valve 55 and quick connect member 57. In this fashion compressed pressurized air can be injected into header 50 for assisting in the movement of material that flows by gravity from hopper interior 38 to a discharge hose 81 and then to a second vessel 82. Such a second vessel 82 can be a cuttings collection and disposal tank such as shown and described in my prior U.S. Pat. Nos. 5,564,509 and 5,402,857. This flow of pressurized air and material is indicated by arrows 58 in FIGS. 1 and 8–10.

Figure 9:
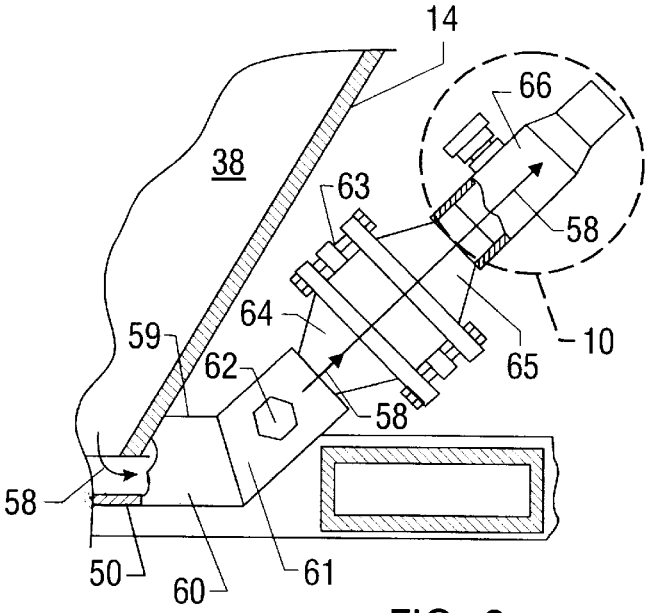
FIG. 9 is a fragmentary sectional elevational view of the preferred embodiment of the apparatus of the present invention showing the discharge piping for removing material from the tank.

The outlet or discharge side of outlet header is shown in FIGS. 1, 2, and 9. An outlet fitting 59 is attached to the interface of wall 14 and channel member 49. The outlet fitting 59 can include a pair of pipe sections 60, 61 that form an angle of about 45 degrees as shown in FIG. 9. A cleanout plug 62 can be provided on fitting 59.

In FIG. 9, a valve such 63 as a ball valve or butterfly valve can be provided for closing the flow of material from channel section 49 to the exterior of hopper 35 when the hopper is subjected to a vacuum. Valve 63 can be mounted between flanges 64, 65. A spool piece 66 with an open ended bore 70 can be fitted to flange 65 for transmitting material from hopper interior 38 via fitting 59 to a suction hose line 78. Fitting 71 on spool piece 66 can be used to couple an air line to the spool piece 66 as an additional means of moving material into discharge line 80 that is being removed from hopper 35 via outlet header 50. The spool piece comprises larger diameter section 67, transition section 68 and smaller diameter section 69.

When the tank apparatus 10 is to be used as a vacuum tank for collecting cuttings as part of a system for collecting oil and gas well drill cuttings, the outlet header 50 is closed by shutting valves 55 and 63. Drill cuttings can then be suctioned into the interior 38 of hopper 35 via one of the openings 36, 37 in top plate 16. This can be accomplished for example using a plate 72 attached to a selected opening 36 or 37 in the top plate of hopper 35 as shown in FIG. 7.

Plate 72 has fittings 73, 74 for quick coupling and connecting respective inlet and outlet hoses 75, 76 to plate 72 when the hopper 35 is to be subjected to a vacuum. The inlet hose 75 is a suction hose for intake of drill cuttings. The discharge hose 76 connects to a vacuum source. Such a vacuum arrangement for vacuum of drill cuttings to a collection tank is shown and described in my prior U.S. Pat. Nos. 5,402,857 and 5,564,509 each of which is hereby incorporated herein by reference.

The following table lists the parts numbers and parts descriptions as used herein and in the drawings attached hereto.

PARTS LIST

PARTS LIST

| Part Number | Description |
|---|---|
| 10 | vacuum tank |
| 11 | frame |
| 12 | inclined sidewall |
| 13 | inclined sidewall |
| 14 | inclined sidewall |
| 15 | hopper wall |
| 16 | top plate |
| 17 | large hatch |
| 18 | small hatch |
| 19 | outlet fitting |
| 20 | rupture disk |
| 21 | flange |
| 22 | flange |
| 23 | outlet opening |
| 24 | elbow |
| 25 | ball valve |
| 26 | tank outlet opening |
| 27 | hatch hinge |
| 28 | hatch hinge |
| 29 | closure |
| 30 | closure |
| 31 | base perimeter beam |
| 32 | column beam |
| 33 | upper perimeter beam |
| 34 | stacking pin |
| 35 | hopper |

-continued

PARTS LIST

| Part Number | Description |
|---|---|
| 36 | opening |
| 37 | opening |
| 38 | interior |
| 39 | rod |
| 40 | rod |
| 41 | socket |
| 42 | socket |
| 43 | horizontal beams |
| 44 | vertical beams |
| 45 | vertical beams |
| 46 | channel section |
| 47 | lower edge |
| 48 | lower edge |
| 49 | upper edge |
| 50 | outlet header |
| 51 | upper edge |
| 52 | inlet fitting |
| 53 | central longitudinal axis |
| 54 | central longitudinal axis |
| 55 | valve |
| 56 | inlet side |
| 57 | quick connect member |
| 58 | arrow |
| 59 | outlet fitting |
| 60 | pipe section |
| 61 | pipe section |
| 62 | cleanout plug |
| 63 | valve |
| 64 | flange |
| 65 | flange |
| 66 | spool piece |
| 67 | larger diameter |
| 68 | transition section |
| 69 | smaller diameter section |
| 70 | bore |
| 71 | plug |
| 72 | plate |
| 73 | fitting |
| 74 | fitting |
| 75 | inlet hose |
| 76 | discharge hose |
| 77 | stiffners |
| 78 | suction hose |
| 79 | lifting eyes |
| 80 | vibrating motion |
| 81 | discharge |
| 82 | second vessel |

The foregoing embodiments are presented by way of example only; the scope of the present invention is to be limited only by the following claims.

What is claimed is:

1. A vacuum tank apparatus, comprising:

a) a frame having a plurality of comers reinforced by structural comer columns;

b) the frame including a base having a structural, generally horizontally extended base that includes a plurality of base perimeter beams, said columns connected structurally to said base at said perimeter beams;

c) the upper end portion of said frame including a plurality of upper perimeter beams, said columns being structurally connected to said base and said upper perimeter beams;

d) a shaped hopper supported by the frame internally of the base and upper perimeter beams, the hopper including an interior and a sidewall comprised of a plurality of inclined wall sections, each wall section including an upper end portion that connects to said frame at said perimeter beams and a lower end portion that extends to another lower end portion of another inclined wall section;

e) an outlet header at the bottom of the hopper next to the lower end portions of the inclined wall sections and including a discharge outlet for discharging material from the hopper interior;

f) a top wall of the hopper having multiple hatches including a first hatch near a first upper perimeter beam and a second hatch next to the second upper perimeter beam that is parallel to the first upper perimeter beam.

2. The tank apparatus of claim 1 wherein the outlet header includes opposed open end portions.

3. The tank apparatus of claim 1 further comprising an air inlet for injecting air into the outlet header.

4. The tank apparatus of claim 1 wherein the inclined wall sections attach to respective side portion of the outlet header.

5. The tank apparatus of claim 4 wherein the outlet header has an open top that communicates with the hopper interior.

6. The tank apparatus of claim 4 wherein the outlet header comprises:

a) a longitudinally extended trough portion with an open top;

b) a pair of opposed end portions of the trough having fittings for attaching flow lines to the outlet header; and c) a closed structure being defined by the fittings, connected hoses, trough, and the lower end of the sidewall.

7. The tank apparatus of claim 1 wherein the hopper is a closed structure that can hold a vacuum, and the lower end of the hopper includes the outlet header, fittings on the outlet header externally of the hopper, and wherein the outlet header includes a trough having a generally U-shaped transverse cross section.

8. The tank apparatus of claim 1 wherein the each of the inclined sidewalls has a lower edge, the outlet header includes a trough having a pair of upper edges, wherein the lower edge of a sidewall is joined to an upper edge of the trough.

9. The tank apparatus of claim 8 wherein the outlet header includes an inlet and an outlet, the inlet having a fitting for attaching a source of pressurized air thereto, the outlet having a fitting for attaching a suction line thereto.

10. A vacuum tank apparatus, comprising:

a) a frame having a plurality of corners reinforced by structural corner columns;

b) the frame including a base having a structural, generally horizontally extended base that includes a plurality of base perimeter beams, said columns connected structurally to said base at said perimeter beams;

c) the frame including an upper end portion including a plurality of upper perimeter beams, said columns being structurally connected to said upper perimeter beams;

d) a hopper supported by the frame and being contained entirely within an envelope defined by the upper and lower perimeter beams and corner columns, the hopper including at least a pair of inclined sidewalls having upper end portions connected to the frame at the upper perimeter beams and lower end portions that approach one another near the lower end of the frame;

e) an outlet header at the bottom of the hopper next to the lower end portions of the inclined sidewalls. the outlet header including a discharge outlet for discharging material from the hopper interior and a trough portion that connects to the lower end of the tank body; and f) a top wall of the hopper having multiple hatches including a first hatch near a first upper perimeter beam and a second hatch next to a second upper perimeter beam that is parallel to the first upper perimeter beam.

11. A vacuum tank apparatus comprising:

a) a tank body having an interior, a top wall, a plurality of sidewalls, at least a pair of said sidewalls being inclined, and a lower end of the tank body, the tank body defining a closed structure that can be subjected to a vacuum;

b) at least one opening in the top wall;

c) a hatch for closing the opening;

d) an inlet for transmitting solid material into the tank interior;

e) an outlet header at the lower end of the tank body for discharging material from the tank interior, the outlet header including a trough portion that connects to the lower end of the tank body, the outlet header having opposed first and second open end portions;

f) a source of pressurized air for injecting air into the outlet header at the first open end portion; and g) a vacuum source for pulling a vacuum on the tank at the second end portion of the outlet header.

12. The tank apparatus of claim 11 wherein the tank includes a frame that surrounds the tank body, the frame including a base, a plurality of comer beams. and an upper end portion including a plurality of upper perimeter beams.

13. The tank apparatus of claims 10 and 12 wherein the frame upper perimeter beams are horizontal and include stacking pins and the frame base beams include sockets for enabling the tank to be stacked upon another tank by fitting the stacking pins of one tank to the sockets of another tank.

14. The tank apparatus of claims 10 or 11 wherein the a trough portion is generally U-shaped.

15. The tank apparatus of claims 10 or 11 wherein the outlet header has an inclined section.

16. The tank apparatus of claims 10 or 11 wherein the frame includes a plurality of comer supports that form an acute angle e with an inclined sidewall.

17. The tank apparatus of claims 10 or 11 wherein two of the sidewalls converge at the trough and extend longitudinally along the trough.

18. A method of removing drill cuttings from an oil and gas well platform that uses a drill bit supported with a drill string and a well drilling fluid during a digging of a well bore, comprising the steps of:

a) separating drill cuttings from the well drilling fluid on the drilling platform so that the drilling fluids can be recycled into the well bore during drilling operations;

b) transmitting the separated cuttings to a cuttings receiving area;

c) A suctioning the separated drill cuttings with a first suction line having an intake end portion that can be positioned at the cuttings receiving area;

d) transmitting the drill cuttings via a the suction line to a first vessel that has an interior, a lower end portion with an outlet header, at least one access opening for communicating with the first vessel interior, and a valve that can disallow flow of material from the first vessel when a vacuum is present in the first vessel interior;

e) forming a vacuum within the first vessel interior with a vacuum source that is in fluid communication with the first vessel interior via a second vacuum line;

f) separating liquids and solids from at least one of the vacuum lines before said liquids and solids can enter the vacuum source; and g) emptying the first vessel of drill cuttings by discharging the cuttings via the outlet header from the first vessel interior to the second vessel.

19. The method of claim 18 wherein the flow velocity in the first suction line is about one hundred to three hundred (100 - 300) feet per second.

20. The method of claim 18 further comprising the step of injecting air into the outlet header.

21. The method of claim 18 wherein the vacuum formed within the tank in step "e" is between about sixteen and twenty-five (16 - 25) inches of mercury.

22. The apparatus of claim 18 wherein the outlet header had end portions that are valved.

23. The method of claim 18 further comprising valves on the outlet header for closing the outlet header when the tank is closed.

24. The method of claim 23 wherein the valves include an air inlet valve and a solid material outlet valve.

25. The method of claim 18 further comprising the step of positioning a separator vessel in between the vacuum source and the first vessel in the second vacuum line.

26. A method of removing drill cuttings from an oil and gas well drilling platform that uses a drill bit supported with a drill string and a well drilling fluid during a digging of a well bore, comprising the steps of:

a) separating drill cuttings from the well drilling fluid on the drilling platform so that the drilling fluids can be recycled into the well bore during drilling operations;

b) transmitting the cuttings to a cuttings receiving area;

c) suctioning the separated drill cuttings from the cuttings receiving area with a suction line having an intake end portion that can be positioned at the cuttings receiving area;

d) transmitting the drill cuttings via the suction line to a vessel that has an interior and an outlet header;

e) forming a vacuum within the interior of the vessel; and f) purging the vessel of drill cuttings through the outlet header.

27. The method of claim 26 wherein in step "d", the outlet header has end portions with valves.

28. The method of claim 26 wherein the flow velocity in the first suction line is about one hundred to three hundred (100 300) feet per second.

29. The method of claim 26 further comprising the step of injecting air into the outlet header during a discharge of the drill cuttings.

30. The method of claim 29 wherein air is injected into the header at an upstream side of the header and cuttings are suctioned at a downstream side of the header.

31. A method of removing drill cuttings from an oil and gas well platform that uses a drill bit supported with a drill string and a well drilling fluid during a digging of a well bore, comprising the steps of:

a) separating drill cuttings from the well drilling fluid on the drilling platform so that the drilling fluids can be recycled into the well bore during drilling operations;

b) transmitting the cuttings to a cuttings collection area;

c) suctioning the separated drill cuttings with a suction line having an intake end portion that can be positioned at the cutting collection area;

d) transmitting the drill cuttings via the suction line to a vessel that has an interior;

e) forming a vacuum within the suction line and vessel interior in steps "a" through "d"; and f) discharging cuttings from the vessel into a second vessel via an outlet header at the bottom of the vessel.

* * * * *

UNITED STATES PATENT AND TRADEMARK OFFICE

CERTIFICATE OF CORRECTION

PATENT NO. : 6,179,070 B1
DATED : January 30, 2001
INVENTOR(S) : Gary H. Dietzen It is certified that error appears in the above-identified patent and that said Letters Patent is hereby corrected as shown below:

Column 7,
Line 54, delete the text "comers" and insert the text -- corners --.

Column 8,
Line 36, delete the text "wherein the each" and insert the text -- wherein each --.
Line 64, delete the text "sidewalls." and insert the text -- sidewalls, --.

Column 9,
Line 26, delete the text "comer beams." and insert the text -- corner beams, --.
Line 28, delete the text "claims 10 and 12" and insert the text -- claims 10 or 12 --.
Line 29, delete the text "and include" and insert the text -- beams including --.
Line 33, delete the text "a".
Line 38, delete the text "comer supports" and insert the text -- corner supports --.
Line 39, delete the text "e".
Line 52, delete the text "A".
Line 55, delete the text "a".

Signed and Sealed this

Twenty-second Day of January, 2002

*Attest:*

*Attesting Officer*

JAMES E. ROGAN
*Director of the United States Patent and Trademark Office*